US005743789A

United States Patent [19]

Russell

[11] Patent Number: 5,743,789

[45] Date of Patent: Apr. 28, 1998

[54] PROCESS FOR FINISHING A PAINTING

[76] Inventor: Rosemarie M. Russell, 3986 Mt. Olympus Way, Salt Lake City, Utah 84124

[21] Appl. No.: 606,691

[22] Filed: Feb. 26, 1996

[51] Int. Cl.[6] ..... B24B 1/00

[52] U.S. Cl. ..... 451/57; 451/59; 451/28; 427/258

[58] Field of Search ..... 451/57, 59, 53, 451/28, 29; 427/264, 140, 258, 355, 416, 407.1; 428/40.6

[56] References Cited

U.S. PATENT DOCUMENTS

| | | | |
|---|---|---|---|
| H244 | 4/1987 | Goodwin | 451/57 |
| 4,254,168 | 3/1981 | Monson | 427/409 |
| 4,745,837 | 5/1988 | Rimsa | 84/291 |
| 4,774,108 | 9/1988 | Cano | 427/262 |
| 5,399,373 | 3/1995 | Mrozinski | 427/140 |
| 5,518,786 | 5/1996 | Johnson et al. | 428/40.6 |

*Primary Examiner*—Robert A. Rose

*Assistant Examiner*—George Nguyen

*Attorney, Agent, or Firm*—M. Reid Russell

[57] ABSTRACT

A process for finishing a painting that is an artist's depiction to have a polish matte, high gloss or other finish where, after the applied paint is thoroughly dry, clear acrylic is applied to the entire painting surface which clear acrylic can itself be colored to provide a tint to the painting, whereafter the painting surface is sanded, using a selected grit or grits of sand paper using wet or dry techniques, or a combination thereof, to smooth the painting surface, and a wax or a polishing compound or compounds is applied thereto, and the selected applied wax or polishing compound or compounds is buffed to a matte, high gloss, or other finish, protecting the painting surface and providing a surface coating that will lend an appearance of depth to the painting subject matter. With, as optional steps in the process, prior to sanding the entire painting surface, selected areas thereof, from a furthest away painting subject matter to closer, may receive an application of a clear acrylic, and such selected area or section are sanded and repainted, adding detail and/or highlighting to the painting subject matter.

6 Claims, 2 Drawing Sheets

PROCESS FOR FINISHING A PAINTING

BACKGROUND OF THE INVENTION

1. Field of the Invention

The invention relates to processes for finishing a painting painted on canvas, particle board, or any other appropriate media.

2. Prior Art

Paintings formed on a variety of media have long been known. Such media has included almost any surface, including walls and ceilings, flat sections of wood, particle board, and canvas, to name only a few. Numerous types and varieties of materials have been used as paints, some of which dry in a short period of time, such as acrylics, water colors, and the like, with paints, such as oils, alkyd, lacquer, or the like, without an added drying agent, tending to dry only after long periods of time. For a practice of the steps of the invention, a quick drying paint, such as an acrylic, that, when dry, will not be affected by contact with water, is preferred. Though, it should be understood, other paints, including oil, alkyd, lacquer, or the like as have had a quick drying agent added thereto can be used in a practice of the steps of the invention.

Heretofore, to form a painting, an artist used a brush, pallet knife, other tool, or the like, to apply different colors of paint onto a surface forming the painting subject matter. Such paint application often involved an application of different colors of paint in multiple layers, until a desired representation is achieved. Whereafter, a transparent coating, as desired, can be applied over the finished painting surface to protect and preserve it. Sealants such as a varnish, lacquer, clear acrylic, wax, or the like, can be so use that are applied with a brush, sprayed or wiped on, or can be applied using another tool or technique. The coating, in practice, can be applied to conform to the contours of the paint or, where a smooth surface has been desired, as where the artist applies a uniform depth of paint over the surface, the coating can be applied with a brush, be sprayed thereon, or both procedures can be used to achieve a smooth surface coating. Where such paint applicant and transparent coating or coatings have provided a smooth coating, such has not been as smooth as can be provided by sanding and polishing the surface, as taught by the invention. In a practice of the process of the invention, interim steps of sanding and repainting to add detail, as needed, and for highlighting the painting subject matter provide an appearance of depth to a finished painting. Such periodic and final sanding steps can be accomplished utilizing fine or coarse grain sand paper, can utilize wet or dry sanding techniques, or the like, and may include a repainting to add detail and a highlighting of the sanded areas, dependant upon the effect that the artist desires to achieve.

SUMMARY OF THE INVENTION

It is a principal object of the present invention to provide a process for finishing a painting to provide a smooth surface that may lend an appearance of depth to the painting subject matter.

Another object of the present invention is to provide a process for finishing a painting that includes, during formation of the painting, sanding sections of the painting surface to smooth that surface, whereafter additional paint may be applied to the sanded sections for adding detail and highlighting the painting subject matter.

Another object of the present invention is to provide a process for finishing a painting where, before the periodic sanding steps a clear acrylic coating may be applied to protect the applied paints and to smooth the surface, which clear acrylic may include coloring to produce a desired tint to the finish.

Another object of the present invention is to provide a process for finishing a painting where, as final finishing steps, the painting surface receives a final clear acrylic coating and is sanded thereover to a smooth finish, and that surface is then polished to provide a smooth high gloss, matte, or like finish, to the painting to protect and to lend an appearance of depth to the painting subject matter.

Still another object of the present invention is to provide a process for finishing a painting where section or sections thereof that, during the process of paint application, are periodically sanded may then be repainted to add further detail to and highlight the painting subject matter, with the painting to receive a final sanding, where the periodic and final sanding steps can be practiced employing wet or dry sanding techniques.

Still another object of the present invention a process for finishing a painting to include applying a polishing compound to and buffing the finished painting surface to provide a smooth high gloss, matte, or like finish, lending to the painting subject matter an appearance of depth.

Still another object of the present invention is to provide a process for finishing a painting where the painting receives a final clear acrylic coating, that may itself be lightly colored and that, after sanding to a smooth surface, receives a polishing compound and/or wax applied thereover that is buffed to a high gloss, with the polished surface protecting the applied paint from absorbing dirt, is easily cleaned with soap and water and which surface, as required, can be stripped and recoated with clear acrylic and repolished without disturbing the painting subject matter.

The invention is in a performance of steps in a process for creating a painting to have, when completed, a smooth polished finish where the applied paint will be protected and the painting subject matter will have an appearance of depth. In a practice of the invention, during painting, areas of the painting may receive a clear acrylic coating applied thereto, and these areas may then be sanded, and repainted to provide protection to the paint and for highlighting and adding detail thereto. The areas as are sanded and repainted are preferably selected from distant subject matter to subject matter as would be closer to the observer. In which repainting the subject matter can be further detailed, with shadowing added, to also add a depth dimension to the work. Such sanding can be performed with fine grain to coarse grain sand paper and may involve wet or dry sanding techniques. To perform the sanding steps it is, of course, necessary that the applied paint be completely dry. Accordingly, to practice this process, an artist must select a paint or paints that will dry in a reasonable period of time, or select paints wherein a drying accelerator is mixed to cause quick drying. Paints as may be utilized for a practice of the process are acrylic paints, or other appropriate paints, and paints that will dry rapidly when a chemical accelerant is added thereto, such as alkyd and oil paints wherein have been mixed a drying accelerator, such as a product known as Liquin, manufactured by Winsor & Newton, of London, England.

In a practice of the invention, to a surface whereon paint has been applied and is thoroughly dry, areas to be sanded are selected, generally from a farthest away painting subject matter to areas representing closer subject matter. Preferably, the farthest away area first receives a coating or coatings of a clear acrylic, that can be tinted as desired, and the area is sanded and then repainted to add detail and highlight features thereof, followed by applying a clear acrylic coating, such as a product known as Liquitex®, manufactured by Binney & Smith, Inc. of Winfield, Kans., sanding and repainting of successively nearer areas or after the painting is finished, until the artist is satisfied that the painting is complete. During the painting and sanding steps, additional paint may be applied, to provide additional shading, and acrylic coatings as are added may be tinted to provide an appearance of a presence of dust, or the like, in the air. With the dear acrylic coating also providing for protecting the painting surface. Such surface protection is warranted, particularly when using acrylic paints to discourage dust and dirt from adhering to the surface paint. Practice of these steps can provide a selected finish from matte to glossy, as determined by the artist.

When the artist is satisfied that the applied and reapplied paints and clear acrylic coats, after sanding, fully represent their creation, a final clear acrylic coating is preferably applied, utilizing Liquitex® over the painting surface and that surface is finally sanded to completely smooth it. Thereafter, a polishing compound, and/or wax, is applied and the surface is buffed, by hand or utilizing a motor driven polishing disk, or the like. Such polishing compounds as are preferred are used sequentially from a larger grit size to a smaller one, and polishing compounds known as Strata 1000TM and Chroma 1500TM, manufactured by Presta Products of Akron, Oh., have been used successfully as have waxes, for practicing the present process. Though, it should be understood, other polishing compounds, and different waxes, could be so used for smoothing and providing a polishing of the painting surface. After buffing or polish, the surface will have a matte, high gloss, or the like, movable to the painting subject matter of the finished painting an appearance of depth

DESCRIPTION OF THE DRAWINGS

In the drawings that represent the best mode presently contemplated for carrying out the invention.

DETAILED DESCRIPTION

Figure 1:
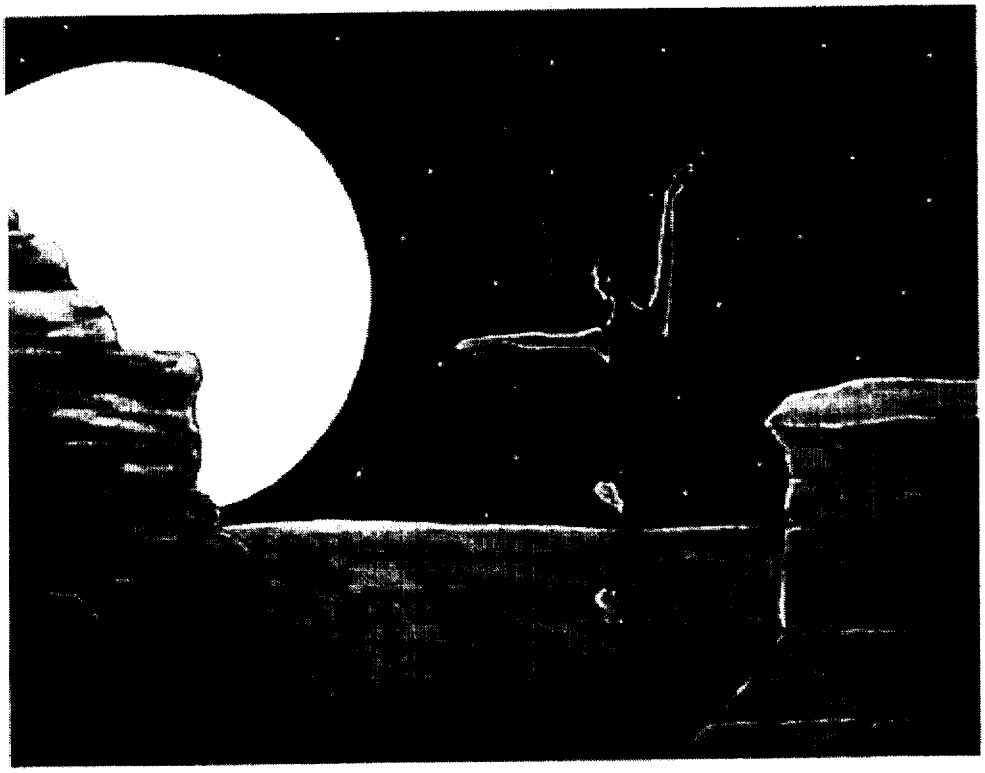
FIG. 1 is a photograph showing a front elevation view of a painting that was finished utilizing the process of the invention.

FIG. 1 shows a photograph of a painting 10 of the inventor whereon the finishing steps of the invention were practiced. The painting 10 of FIG. 1 is drawn in FIG. 2 to show sections or areas or hatching represented by different sloping and thickness of parallel lines. Shown therein, a section or area of the painting representing a nighttime sky 11 is identified with equal spaced diagonal lines that slope downwardly from left to right. A section or area representing the moon 12 is shown without hatching, with spaced hatching lines that slope downwardly from right to left identifying rocky areas 13. An area or section of ground 14 is identified by spaced horizontal parallel lines, and a dancer 15, shown in a dance position standing on ground 14, is shown with equal spaced thick vertical hatching lines.

For practicing the process of the invention, paint as has been applied to the painting surface must be dry prior to sanding sections or areas thereof, utilizing wet or dry sanding techniques. Accordingly, to practice in the invention, an artist must utilize quick drying paints or be prepared to wait until the applied paint is dry before proceeding with an optional application of a coating or coatings of a clear acrylic. Accordingly, acrylic paints, or an alkyd, lacquer, oil paint, or the like, wherein a drying accelerator has been mixed, are preferred for use, and one such drying accelerator is known as Liquin, that is manufactured by Winsor & Newton, or London, England, that, it is believed, can be used to promote quick drying of alkyd, lacquer and oil paints. For the described practice of the invention acrylic paints have been used though, as set out, it should be understood that other paints can also be so used within the scope of this disclosure.

Figure 2:
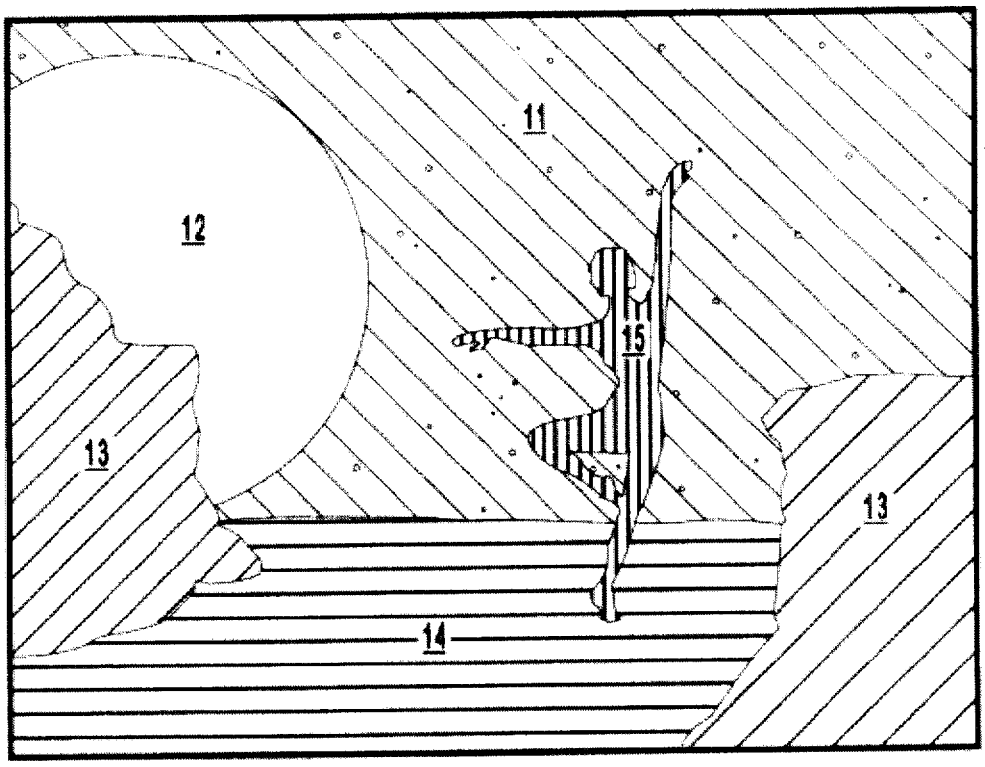
FIG. 2 is front elevation view like that of FIG. 1 showing areas of the painting with different hatching there over for illustrating areas or sections of the painting as may have received clear acrylic coatings, were sanded and then repainted during the painting process.
Figure 3:
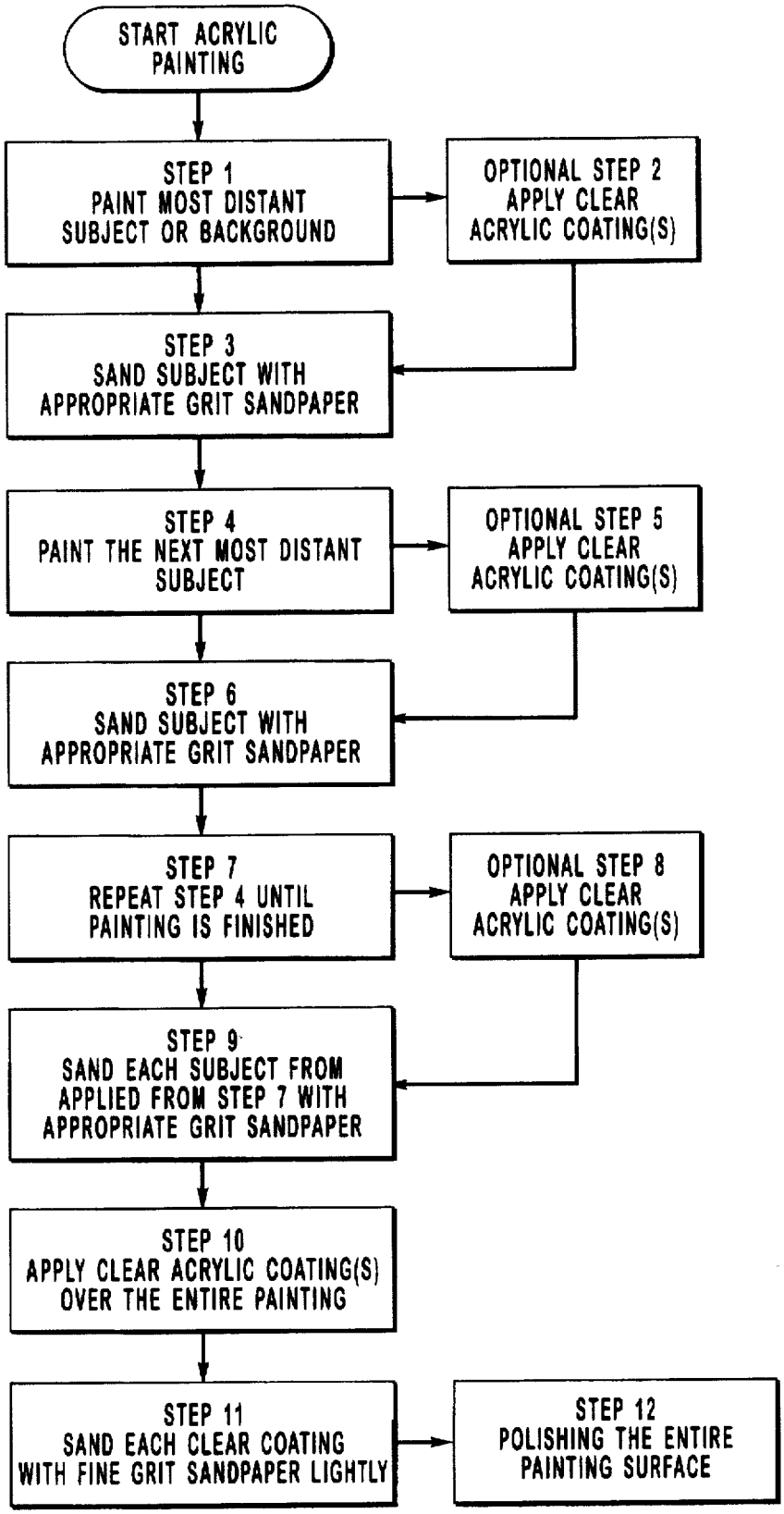
FIG. 3 is a block flow schematic setting out the steps of the invention.

FIG. 3 sets out a block flow schematic of required and optional steps of the invention that are practiced in the process for finishing a painting of the invention. Shown therein are set out a number of steps practiced on to a surface that has been painted to include sanding, utilizing wet or dry sanding techniques, the surface of the sections or areas of the surface and then reapplying paint to highlight, add detail, or the like, to these areas. Also shown are respective optional coatings of the sections or areas, prior to sanding, with clear acrylic, and then sanding and repainting these sections or areas, which selected sections or areas preferably proceed from most distant painting subject matter to most proximate subject matter. For example, as shown in FIG. 2, sky 11 is a most distant point, area or section, with moon 12 next, with rocks 13 closer areas, and the sandy surface 14 the closest section or area, and with a dancer 15 shown dancing on the sandy surface 14. Accordingly, as shown in FIG. 3, the process is preferably practiced, from most distant to closer sections or areas of the painting 10 subject matter.

In a practice of the steps, shown in FIG. 3, the subject matter section or areas are painted, and that paint allowed to dry. Whereafter, a clear acrylic can be applied to a selected section or area that may, as desired, be colored to produce a tint to that coating as could simulate dust in the air, or the like, and the section or area is then sanded. In which sanding, a coarse or fine sandpaper, or combination thereof, can be used to smooth the surface, and wet or drying sanding techniques can be utilized, as determined by the artist. Such clear acrylic coating provides for protecting the applied paints, particularly acrylic paints, in that acrylic paints are reputed to absorb dirt over time, therefore, such clear coating will serve also to protect the paint from absorbing dirt, maintaining the quality of the acrylic paint colors.

Shown in FIG. 3, and as set out above, the sections or area of the painting subject matter are preferably selected from a greatest through successively lesser distances to a closest distance as an observer of the scene being represented would perceive, as determined by the artist. It should, however, be understood, that a practice of the invention need not involve the intermediate steps of painting sections or areas, shown as steps 1 through 6 and 8 need only involve steps 7, 11 and 12, but preferably includes step 10 calling for applying a clear acrylic coating over the entire painting that is then sanded, utilizing different grits of sand paper and employing a wet or drying sanding process then polishing the surface as set out in step 12. A practice of steps 1 through 6 is for providing detail and highlighting to the painting subject matter for giving an appearance of depth thereto. Accordingly, a finished painting, step 7, will optionally receive a clear acrylic coating or coatings, shown as step 8, with, after drying, the entire painting surface is sanded, using an appropriate grit of sandpaper, that may involve a wet or drying sanding techniques. A practice step 9 is to smooth the painting surface, as determined by the artist. Whereafter a final coating or coatings of a clear acrylic, step 10, is preferably applied over the entire painting surface. After a complete and thorough drying of the clear acrylic coating, that may itself be colored to tint the painting surface, as set out in step 11, that surface is subjected to a final sanding, utilizing an appropriate grit of sandpaper, as determined by the artist, to smooth the painting surface. A wax polishing compound or compounds is then applied to the smooth painting surface, and that surface is buffed, as shown in step 12, to a matte, high gloss or other finish. In a practice of this step 12, it is preferred to select, an appropriate wax, or, when utilizing a buffing compound or compounds, as a first polishing compound or compounds having a greater grit to is selected to provide further surface smoothing, followed by compounds containing lesser grit size, or sizes, to polish that surface to a matte, high gloss or other finish. Accordingly, polishing compounds of larger or greater grit size to compounds with lesser grit size are preferably sequentially utilized. In practice, polishing compounds known as Strata 1000TM and Chroma 1500 TM, both manufactured by Presta Products of Akron, Oh., have been used to practice the present process. The smooth polished painting surface provides an appearance of depth to the painting subject matter as portrayed therein, and may, if color has been included in one or more of the clear acrylic coatings, present an all-over tint to represent, for example, distant subject matter, pollutants in the air, or the like. The acrylic coating and polished surface also provides a barrier to paint oxidation or fading, and prohibits the applied paint from absorbing dirt as unprotected acrylic paints are reputed to do.

The invention, as set out above, may involve, during the painting process, painting of a selected area or areas, an application of a clear acrylic coating or coatings to the selected area or areas, a sanding of the area or areas, utilizing a wet or dry technique, or a combination of both, and repainting to add detail and highlight the painting subject matter. These steps may continue to where the artist deems the painting to be finished. To a finished painting, a clear acrylic coating may be applied over the painting surface, and when dried, is sanded to a smooth surface finish. A wax polishing compound or compounds is or are then applied and the surface is buffed to a matte, high gloss, or other finish. It should, however, be understood that, in a practice of the invention, the intermediate steps of painting sections or areas as well as optionally applying an acrylic coating thereto, with sanding and repainting, need not be practiced, as the artist determines, and that the invention may be practiced on a completed painting that, after drying receives a final sanding, utilizing a selected grit or grits of sand paper, utilizing either a wet or dry techniques, as determined by the artist. Whereafter a wax alone selected polish compound or compounds is applied, with a larger grit of polishing compound applied first, and the surface buffed, providing further surface smoothing, to a final smooth, matte, high gloss, or other finish. Which buffing is preferably accomplished utilizing an electric buffer turning a cloth polishing disk, or the like.

It should be understood that, while a preferred practice of my invention in a process for finishing a painting has been shown and described herein, the present disclosure is made by way of example only and that variations and changes are possible without departing from the invention subject matter, and a reasonable equivalency thereof, coming within the scope of the following claims, which claims I regard as my invention.

I claim:

1. A process for finishing a painting consisting of the steps of, to a painted surface of an artist's depiction, during the creation thereof, selecting at least one section of the painting for enhancement; sanding said section to smooth said section surface and reapplying paint to said at least one section; after the paint applied to the entire painting has dried, applying at least one coating of an acrylic material to the entire painting surface; after sanding the acrylic coated surface to smooth it; applying a wax or polishing compound the acrylic material has dried to said acrylic surface; and buffing said entire painted surface to a finish.

2. A process for finishing a painting as recited in claim 1, further including mixing a selected color in the acrylic materialto tint it prior to its application to the painting surface.

3. A process for finishing a painting as recited in claim 1, wherein in fulfillng the entire painted surface more than one coating of a polishing compound from a greater grit to a lesser grit is applied to the painting surface and each coating is in turn buffed.

4. A process for finishing a painting as recited in claim 1, wherein the sanding is performed utilizing a wet or dry technique, or a combination thereof.

5. A process for finishing a painting as recited in claim 1, further including, to the selected section of the painting, applying a coating of a clear acrylic material that, after drying, is sanded.

6. A process for finishing a painting as recited in claim 1, wherein the painting surface whereover the wax or polishing compound is applied is buffed utilizing an electrically powered buffing machine turning a polishing disk.

* * * * *

UNITED STATES PATENT AND TRADEMARK OFFICE
CERTIFICATE OF CORRECTION

PATENT NO. : 5,743,789

DATED : April 28, 1998

INVENTOR(S) : Rosemarie M. Russell

It is certified that error appears in the above-identified patent and that said Letters Patent is hereby corrected as shown below:

In Claim 1 at column 6, line 26, after the word "after" add --the acrylic material has dried--; and at line 28 delete "the acrylic material has dried".

Claim 2, at column 6, line 32, delete "materialto" and add --material to--.

Claim 3, at column 6, line 35, delete the words "in fulfilling" should read --in buffing--.

Claim 5, at column 6, line 44, after "of a" delete "clear".

Signed and Sealed this

Seventeenth Day of November, 1998

*Attest:*

Bruce Lehman

BRUCE LEHMAN

*Attesting Officer*

*Commissioner of Patents and Trademarks*